US008382618B2

(12) United States Patent
Lo

(10) Patent No.: US 8,382,618 B2
(45) Date of Patent: Feb. 26, 2013

(54) PROTECTIVE COVER FOR AN INFLATABLE BALL BODY, AND SPORTS BALL HAVING THE SAME

(76) Inventor: Chuan-Hsin Lo, Hua-Lien Hsien (TW)

( * ) Notice: Subject to any disclaimer, the term of this patent is extended or adjusted under 35 U.S.C. 154(b) by 215 days.

(21) Appl. No.: 12/951,751

(22) Filed: Nov. 22, 2010

(65) Prior Publication Data

US 2012/0129635 A1 May 24, 2012

(51) Int. Cl.
*A63B 41/08* (2006.01)

(52) U.S. Cl. ..... 473/596; 473/599; 473/603

(58) Field of Classification Search ..... 473/594, 473/595, 596, 597, 599, 603–605
See application file for complete search history.

(56) References Cited

U.S. PATENT DOCUMENTS

| | | | | |
|---|---|---|---|---|
| 1,666,099 | A * | 4/1928 | Kingman | 428/11 |
| 1,931,429 | A * | 10/1933 | Buckner et al. | 473/596 |
| 2,011,760 | A * | 8/1935 | Gallinant | 473/596 |
| 2,194,674 | A * | 3/1940 | Riddell | 473/597 |
| 2,270,553 | A * | 1/1942 | Potito | 473/596 |
| 2,931,653 | A * | 4/1960 | Gow et al. | 473/596 |
| 4,531,737 | A * | 7/1985 | Jacobson et al. | 473/597 |
| 4,979,751 | A * | 12/1990 | Sullivan, III | 473/570 |
| 5,123,869 | A * | 6/1992 | Schipmann | 446/46 |
| 5,135,222 | A * | 8/1992 | Spector | 473/576 |
| 5,730,287 | A * | 3/1998 | Martin | 206/315.9 |
| 6,547,703 | B1 * | 4/2003 | Swezey et al. | 482/91 |
| 6,656,066 | B2 * | 12/2003 | Barker | 473/570 |
| 6,688,998 | B2 * | 2/2004 | Hergert et al. | 473/599 |
| 7,485,058 | B1 * | 2/2009 | Payne et al. | 473/607 |
| 2006/0283907 | A1 * | 12/2006 | Green et al. | 224/637 |
| 2007/0017947 | A1 * | 1/2007 | Fenton et al. | 224/650 |

* cited by examiner

*Primary Examiner* — Steven Wong
(74) *Attorney, Agent, or Firm* — Stroock & Stroock & Lavan LLP

(57) ABSTRACT

A protective cover for covering an inflatable ball body includes: a flexible surrounding wall capable of forming a receiving space that is substantially ball-shaped and that is adapted to receive a ball, the surrounding wall having inner and outer surfaces, the inner surface being adapted to contact intimately an external surface of the ball when the ball is in an inflated operative state, the surrounding wall having at least one first opening extending through the inner and outer surfaces, the first opening having a size sufficient for access of the ball when the ball is deflated.

2 Claims, 8 Drawing Sheets

PROTECTIVE COVER FOR AN INFLATABLE BALL BODY, AND SPORTS BALL HAVING THE SAME

BACKGROUND OF THE INVENTION

1. Field of the Invention

This invention relates to a protective cover and a sports ball, more particular to a protective cover for covering an inflatable ball body.

2. Description of the Related Art

The external shell of a conventional sports ball, such as a football, a basketball, a soccer, a volleyball, etc., can not be replaced. It is wasteful when, in the event that the shell is worn out, the sports ball has to be discarded even though an inner bladder and an inflating valve of the ball are still intact.

Besides, the requirement for the surface roughness of the external shell of the sports ball varies with users. For example, a beginner requires a sports ball with a rough external shell so as to be able to control the ball more easily; a professional contrarily demands a smoother external shell for improving the technique of playing the ball. A conventional sports ball with an unchangeable external shell can not adapt to the different requirements of different users.

SUMMARY OF THE INVENTION

Therefore, an object of the present invention is to provide a protective cover that is able to reduce the abrasion of the external shell of a sports ball and to vary the surface roughness of the ball for suiting the requirements of different users.

According to one aspect of the present invention, a protective cover for covering an inflatable ball body comprises: a flexible surrounding wall capable of forming a receiving space that is substantially ball-shaped and that is adapted to receive a ball. The surrounding wall has inner and outer surfaces. The inner surface is adapted to contact intimately an external surface of the ball when the ball is in an inflated operative state. The surrounding wall has at least one first opening extending through the inner and outer surfaces. The first opening has a size sufficient for access of the ball when the ball is deflated.

According to another aspect of the present invention, a sports ball comprises: an inflatable ball body; and a protective cover including a flexible surrounding wall capable of forming a receiving space to receive the inflatable ball body. The surrounding wall has inner and outer surfaces. The inner surface is in intimate contact with an external surface of the inflatable ball body when the inflatable ball body is in an inflated operative state. The surrounding wall has at least one first opening extending through the inner and outer surfaces. The first opening has a size sufficient for access of the inflatable ball body when the inflatable ball body is deflated.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
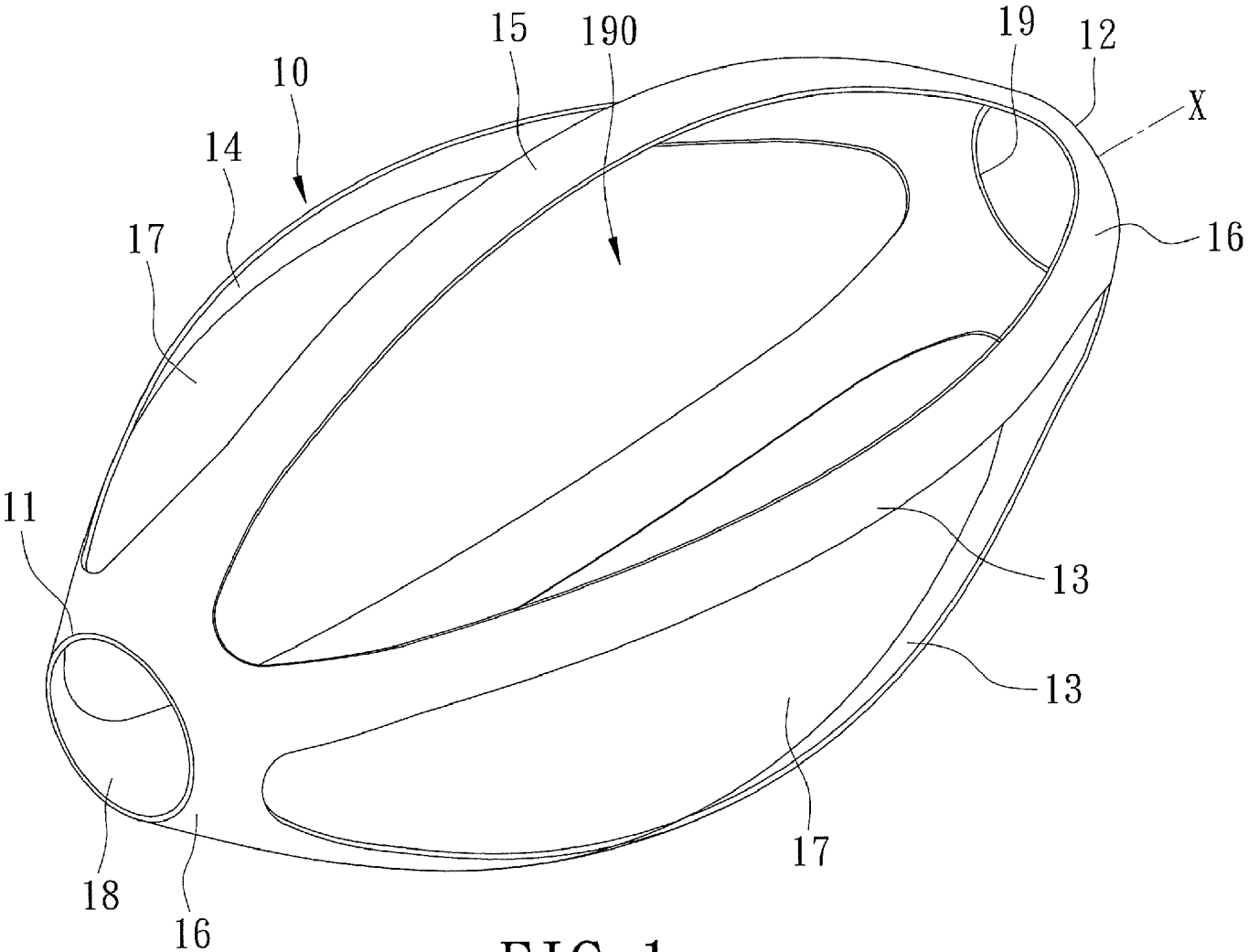
FIG. 1 is a perspective view of the first preferred embodiment of a protective cover according to this invention.

Before the present invention is described in greater detail with reference to the accompanying preferred embodiments, it should be noted herein that like elements are denoted by the same reference numerals throughout the disclosure.

Figure 2:
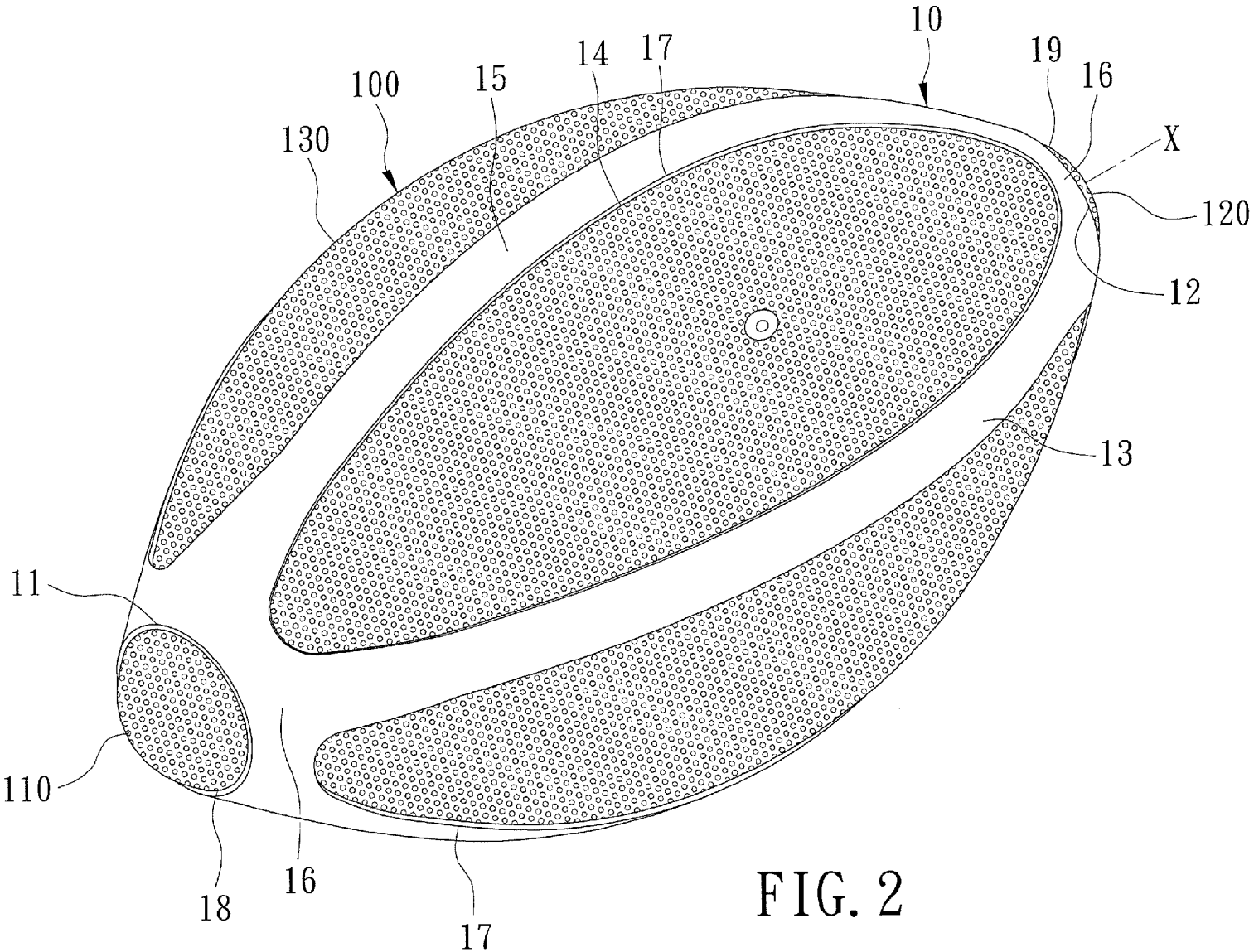
FIG. 2 is a perspective view showing the first preferred embodiment in a state of use where a ball is received in the protective cover.
Figure 3:
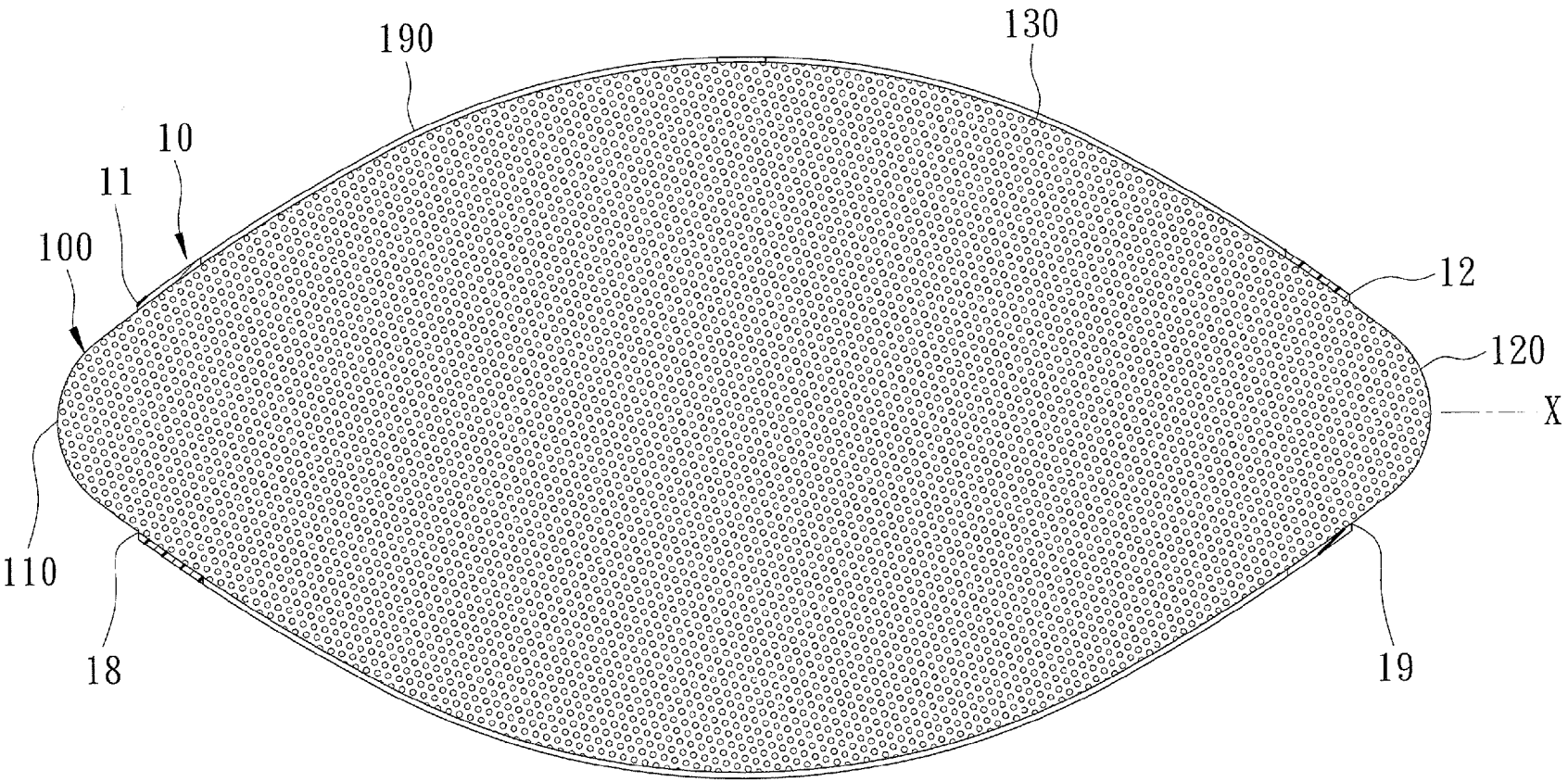
FIG. 3 is a partly cross sectional view of FIG. 2.

Referring to FIGS. 1 to 3, the first preferred embodiment of a protective cover for covering an inflatable ball body of the present invention comprises a flexible surrounding wall 10 capable of forming a receiving space 190 that is substantially ball-shaped and that is adapted to receive an inflatable ball body 100.

The inflatable ball body 100 has two opposite ends 110, 120, and an external surface 130. In this preferred embodiment, the inflatable ball body 100 is a football. Alternatively, the inflatable ball body 100 may be one of a basketball, a soccer, a volley ball, etc.

The surrounding wall 10 of the protective cover has an inner surface 14, an outer surface 15, a plurality of first openings 17 extending through the inner and outer surfaces 14, 15, and a plurality of elongate strap portions 13 that are defined among the first openings 17. The inner surface 14 is adapted to contact intimately the external surface 130 of the inflatable ball body 100 when the ball body 100 is in an inflated operative state. The first openings 17 have a size sufficient for access of the ball body 100 when the ball body 100 is deflated.

Preferably, the surrounding wall 10 of the protective cover further has two positioning holes 18, 19 disposed at two opposite ends 11, 12 of the surrounding wall 10 that are opposite along an axis (X) of the surrounding wall 10, and two annular strap portions 16 each defining the positioning holes 18, 19 (see FIG. 2). The elongate strap portions 13 are connected integrally to the annular strap portions 16. The first openings 17 are larger than the positioning holes 18, 19 and are spaced apart from each other between the annular strap portions 16. More preferably, the first openings 17 are spaced apart angularly from each other between the annular strap portions 16.

In particular, the surrounding wall 10 may be made of a material selected from the group consisting of plastics, natural rubber, synthetic rubbers, thermoplastic elastomers, and thermoplastic rubbers so as to provide the protective cover with a rough surface having an anti-slip property. Alternatively, the surrounding wall 10 may be made of a material selected from the group consisting of silicone rubber, polyurethane, polypropylene, polyethylene, and polyvinyl chloride so as to provide the protective cover with a smooth surface. In addition, the surrounding wall 10 can be made of acrylonitrile-butadiene-styrene (ABS) or acrylic, and the protective cover made therefrom has a transparent surface.

The inflatable ball body 100 can be disposed in the receiving space 190 of the surrounding wall 10 through one of the first openings 17 when the ball body 100 is in a deflated non-operative state. The two opposite ends 110, 120 of the inflatable ball body 100 protrude outwardly and respectively from the annular strap portions 16 of the surrounding wall 10 of the protective cover through the positioning holes 18, 19. After the inflatable ball body 100 is inflated, i.e., in an inflated operative state, the inner surface 14 of the surrounding wall 10 is adapted to contact intimately the external surface 130 of the inflatable ball body 100, and the two opposite ends 110, 120 of the ball body 100 are held stably in the positioning holes 18, 19 of the surrounding wall 10.

By covering the inflatable ball body 100 with the protective cover, the strength and wear resistance of the inflatable ball body 100 are improved. For an inflatable ball body with a worn-out external shell and an air bladder and an inflating valve that are still intact, the protective cover can be provided on the ball body for a longer service life. Moreover, by virtue of the various materials of the protective cover, the surface roughness of the protective cover can be selected to fit different requirements of different users.

Figure 4:
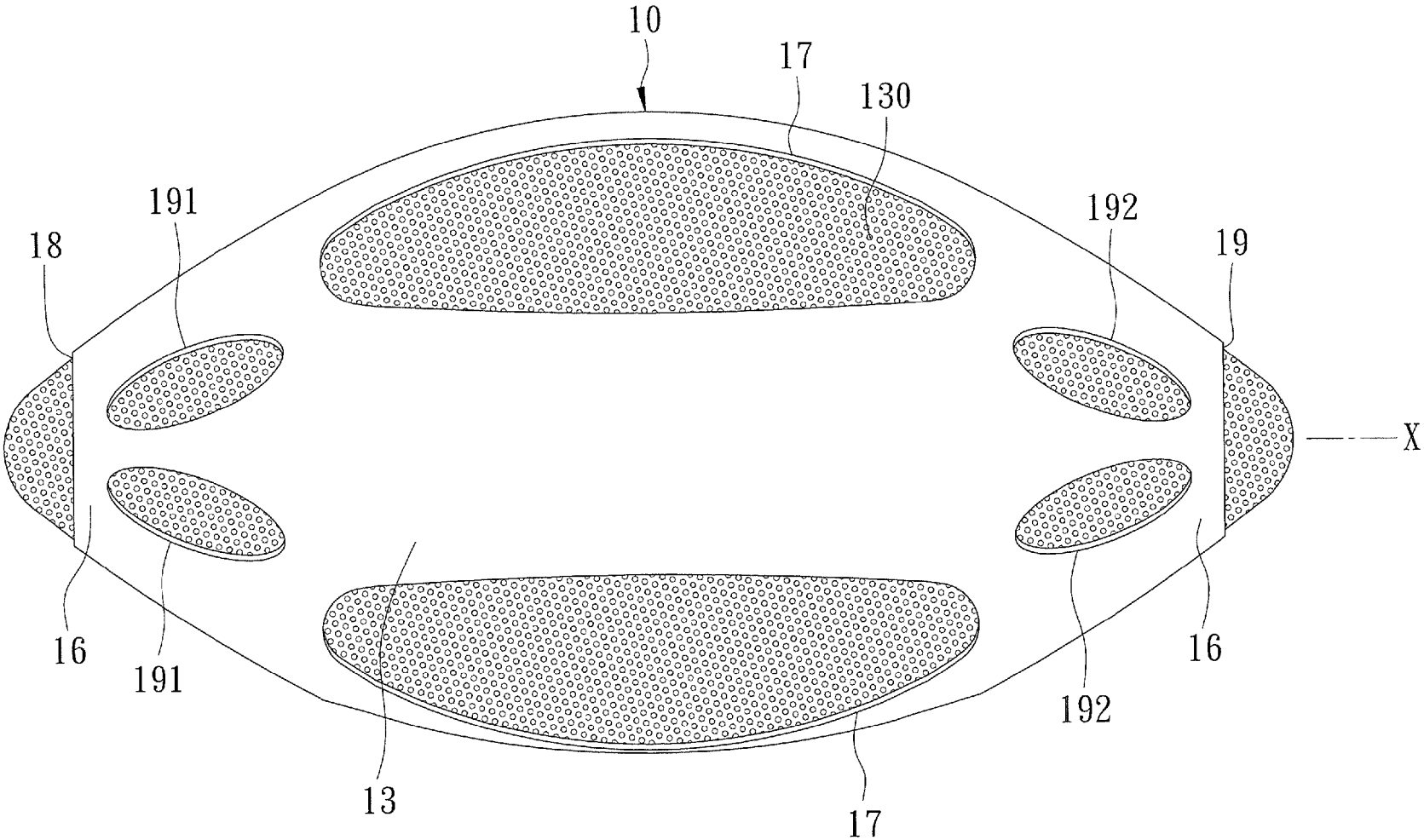
FIG. 4 is a side view of the second preferred embodiment of a protective cover in a state of use where a ball is received therein.

FIG. 4 shows the second preferred embodiment of a protective cover according to the present invention. This preferred embodiment differs from the first preferred embodiment in that the surrounding wall 10 further has a plurality of second openings 191 spaced apart angularly and formed between the first openings 17 and the positioning hole 18, and a plurality of third openings 192 spaced apart angularly and formed between the first openings 17 and the other positioning hole 19. Preferably, the first openings 17 are larger than the second and third openings 191, 192.

Figure 5:
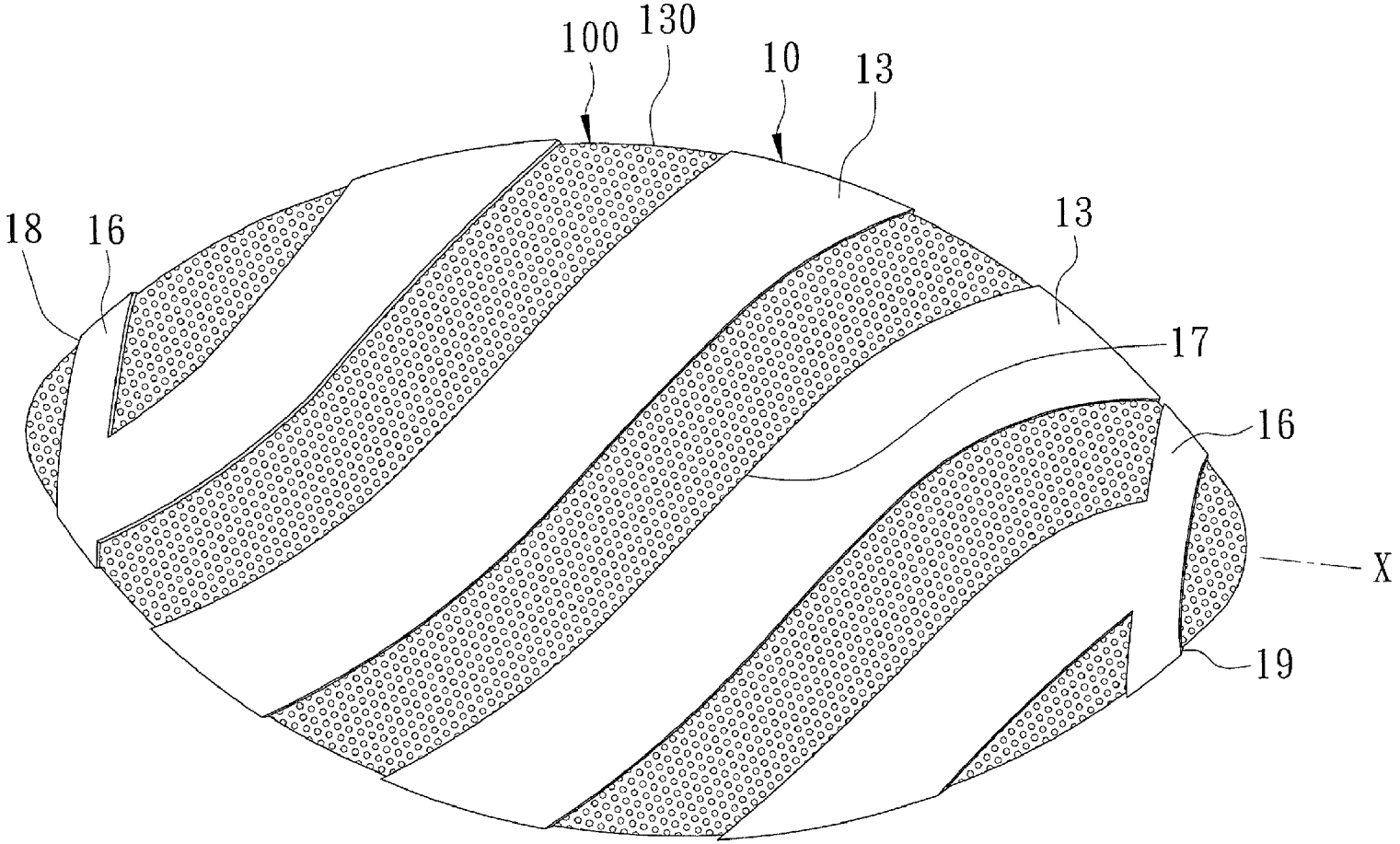
FIG. 5 is a side view of the third preferred embodiment of a protective cover in a state of use where a ball is received therein.

FIG. 5 shows the third preferred embodiment of a protective cover according to the present invention. This preferred embodiment differs from the first preferred embodiment in that the elongate strap portions 13 and the first openings 17 of the surrounding wall 10 extend helically between the positioning holes 18, 19.

Figure 6:
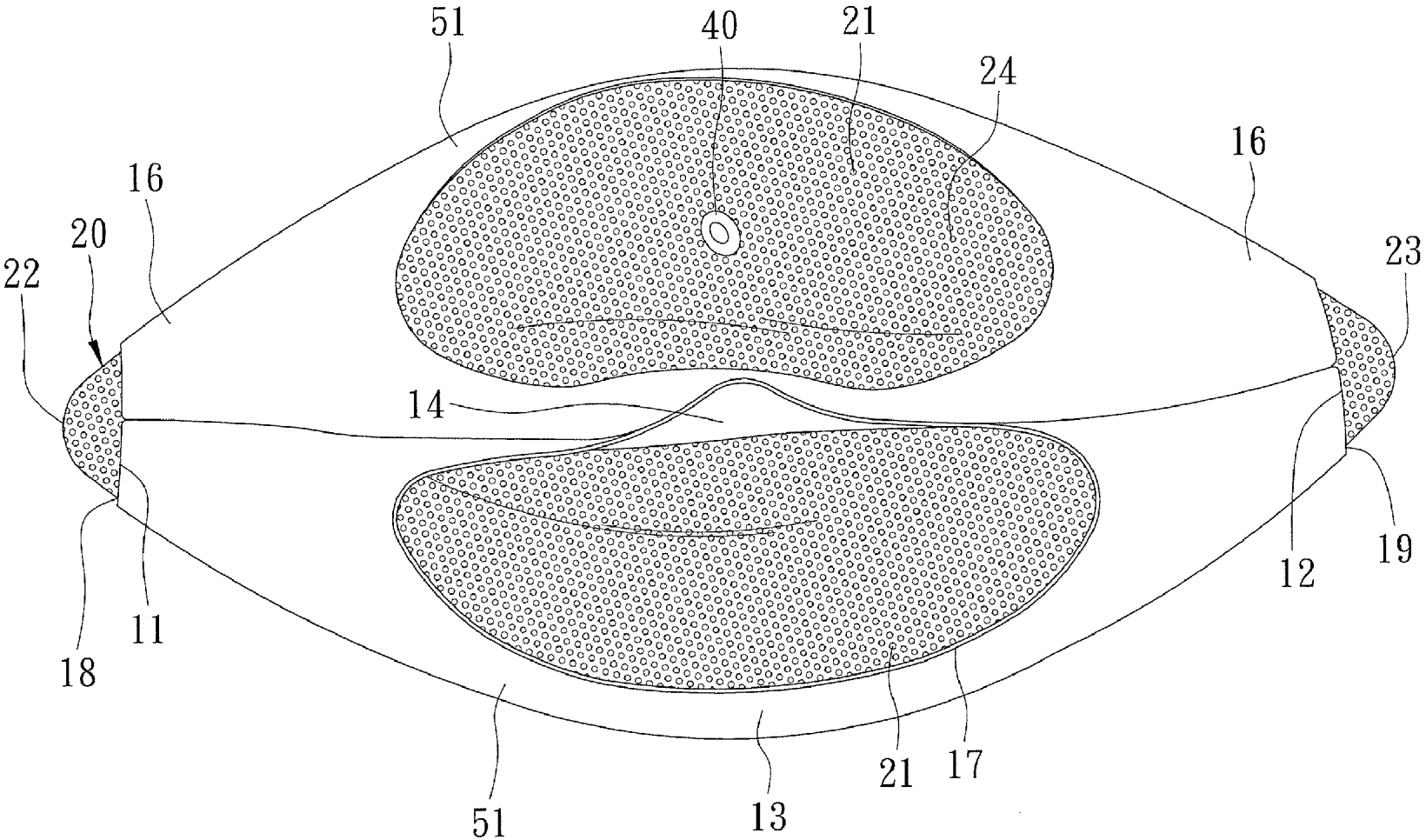
FIG. 6 is a side view of the preferred embodiment of a sports ball according to this invention, showing the sports ball in a deflated non-operative state.
Figure 7:
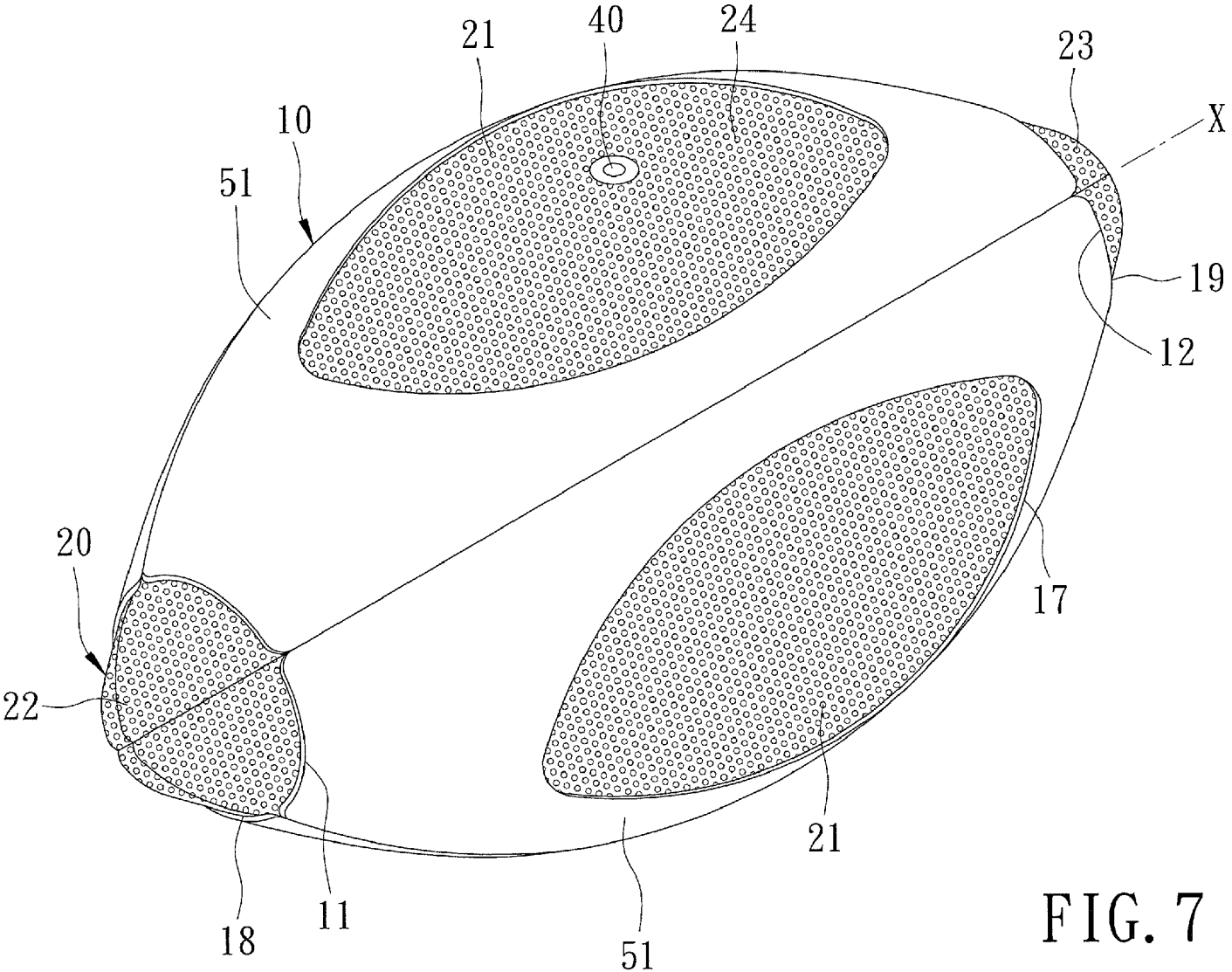
FIG. 7 is a perspective view showing the preferred embodiment of the sports ball in an inflated operative state.
Figure 8:
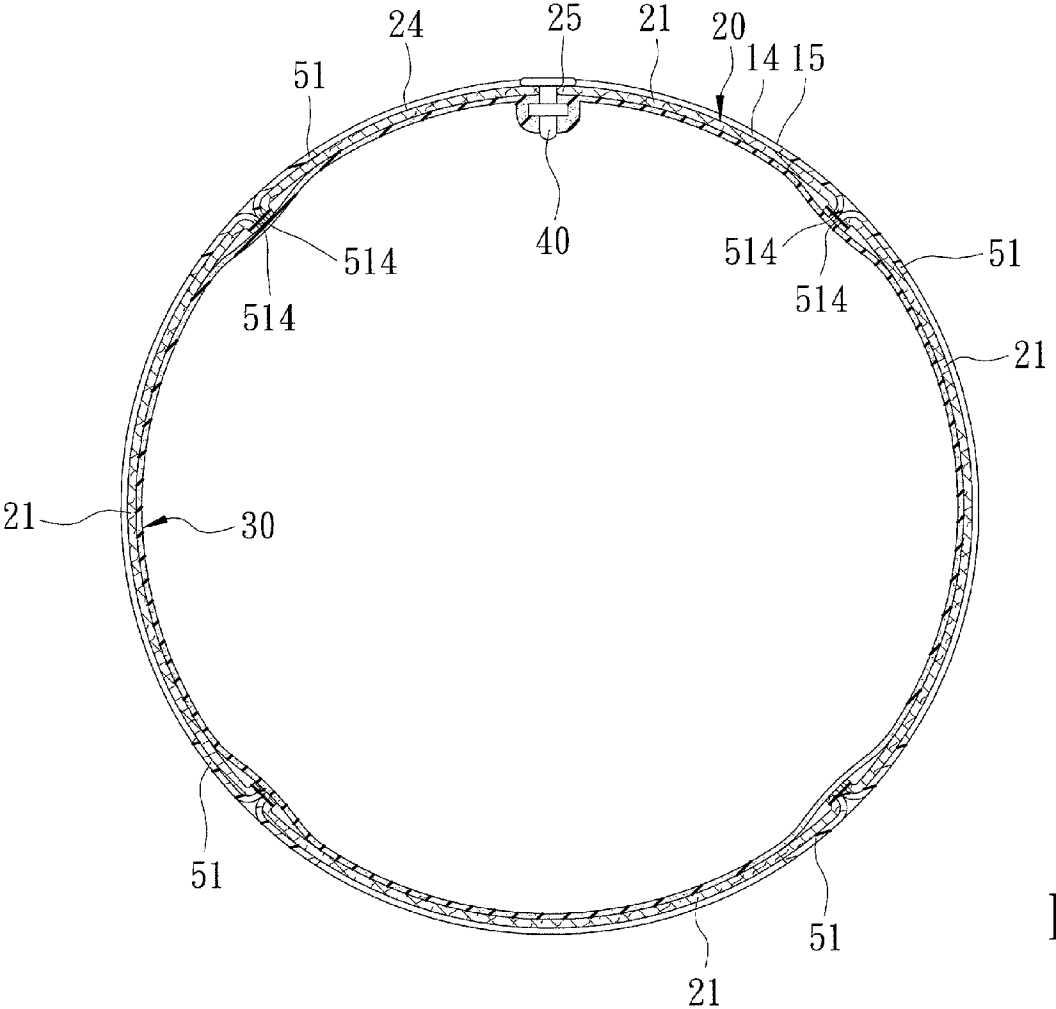
FIG. 8 is a cross sectional view of the preferred embodiment of the sports ball.

Referring to FIGS. 6 to 8, the preferred embodiment of a sports ball according to the present invention includes an inflatable ball body 20 having an external surface 24, and the protective cover shown in FIG. 1. Alternatively, the protective cover used in the sports ball of this invention can also be the one shown in FIG. 4 or FIG. 5.

The inflatable ball body 20 of the sports ball includes a shell that is composed of a plurality of sheet segments 21 and that has two opposite ends 22, 23 protruding outwardly and respectively from the annular strap portions 16 of the surrounding wall 10 through the positioning holes 18, 19, an air bladder 30 disposed within the shell, and an inflating valve 40 attached to the air bladder 30. The plurality of sheet segments 21 are juxtaposed angularly and are stitched together to form the shell. The shell of the inflatable ball body 20 has a slot 25 exposed from one of the first openings 17. The inflating valve 40 extends out of the slot 25.

In this preferred embodiment, the surrounding wall 10 of the protective cover further has a plurality of wall segments 51 that are juxtaposed angularly and stitched together to form the surrounding wall 10. Each of the wall segments 51 has two angularly opposite lateral ends 514 that are sewn respectively to two angularly opposite lateral ends of one of the sheet segments 21 and that are also sewn respectively to two adjacent ones of the wall segments 51.

As shown in FIG. 7, the inner surface 14 of the surrounding wall 10 of the protective cover is in intimate contact with the external surface 24 of the inflatable ball body 20 when the inflatable ball body 20 is in an inflated operative state. On the contrary, as shown in FIG. 6, the inner surface 14 is not in intimate contact with the external surface 24 of the inflatable ball body 20 when the ball body 20 is deflated.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A sports ball, comprising:

an inflatable ball body: and a protective cover including as flexible surrounding wall capable of forming a receiving space to receive said inflatable ball body, said surrounding wall haying inner and outer surfaces, said inner surface being in intimate contact with an external surface of said inflatable ball body when said inflatable ball body is in an inflated operative state, said surrounding wall having at least one first opening extending through said inner and outer surfaces, said first opening having a size sufficient for access of said inflatable ball body when said inflatable ball body is deflated;

wherein said surrounding wall has a plurality of said first openings, said surrounding wall further having a plurality of elongate strap portions that define thereamong said first openings;

wherein said surrounding wall further has two positioning holes disposed at two opposite ends of said surrounding wall that are opposite along an axis of said inflatable ball body, and two annular strap portions each defining said positioning holes, said elongate strap portions being connected integrally to said annular strap portions, said first openings being larger than said positioning holes and being spaced apart from each other between said annular strap portions;

wherein said inflatable ball body includes a shell that has two opposite ends protruding outwardly and respectively from said annular strap portions: and wherein said shell of said inflatable ball body comprises a plurality of sheet segments that are juxtaposed angularly and stitched together to form said shell, said surrounding wall further having a plurality of wall segments that are juxtaposed angularly and stitched together to form said surrounding wall, each of said wall segments having two angularly opposite lateral ends that are sewn respectively to two angularly opposite lateral ends of one of said sheet segments and that are also sewn respectively to two adjacent ones of said wall segments.

2. The sports ball of claim 1, wherein said inflatable ball body further has an air bladder disposed within said shell and an inflating valve attached to said air bladder, said shell of said inflatable ball body having a slot exposed from one of said first openings, said inflating valve extending out of said slot.

* * * * *